US012054831B1

(12) United States Patent
Arumugam et al.

(10) Patent No.: US 12,054,831 B1
(45) Date of Patent: Aug. 6, 2024

(54) METHODS OF MANIPULATING SURFACES FOR EXTREME HYDROPHILIC, HYDROPHOBIC OR OMNIPHOBIC BEHAVIOR AND APPLICATIONS THEREOF

(71) Applicant: Oceanit Laboratories, Inc., Honolulu, HI (US)

(72) Inventors: Ganesh Kumar Arumugam, Honolulu, HI (US); Ashavani Kumar, Honolulu, HI (US); Vinod P. Veedu, Houston, TX (US)

(73) Assignee: Oceanit Laboratories, Inc., Honolulu, HI (US)

( * ) Notice: Subject to any disclaimer, the term of this patent is extended or adjusted under 35 U.S.C. 154(b) by 393 days.

(21) Appl. No.: 16/517,166

(22) Filed: Jul. 19, 2019

Related U.S. Application Data

(63) Continuation-in-part of application No. 14/859,238, filed on Sep. 18, 2015, now abandoned, which is a continuation of application No. 13/951,065, filed on Jul. 25, 2013, now abandoned.

(60) Provisional application No. 61/675,634, filed on Jul. 25, 2012.

(51) Int. Cl.
*C25D 11/00* (2006.01)
*C23C 28/04* (2006.01)
*C25D 11/18* (2006.01)

(52) U.S. Cl.
CPC ..... *C23C 28/04* (2013.01); *C25D 11/18* (2013.01)

(58) Field of Classification Search
None
See application file for complete search history.

(56) References Cited

U.S. PATENT DOCUMENTS 5,126,210 A * 6/1992 Wieserman ..... C25D 11/10 430/278.1
2004/0146560 A1* 7/2004 Whiteford ..... B82Y 30/00 424/484
2014/0110263 A1* 4/2014 Barbier ..... C25D 11/08 205/171

FOREIGN PATENT DOCUMENTS

EP 0514661 A2 * 11/1992 ..... C25D 11/04
KR 20100022158 * 3/2010 ..... C08J 5/22
KR 20110010137 * 10/2011 ..... C25D 11/04

OTHER PUBLICATIONS

Kim et al., "Complete wetting characteristics of micro/nano dual-scale surface by plasma etching to give nanohoneycomb structure", Current Applied Physics , 12, p. 219-224, 2012 (Year: 2012).*

(Continued)

*Primary Examiner* — Stefanie S Wittenberg
(74) *Attorney, Agent, or Firm* — Fresh IP PLC; Clifford D. Hyra; Aubrey Y. Chen

(57) ABSTRACT

A surface modification method involves oxidizing a surface of a material and etching the surface, and repeating the oxidizing and etching one or more times until desired nanostructures are created in the surface. The desired nanostructures make the nanostructured surface superhydrophilic. Hydrophilic properties of the surface may be further developed by application of hydrophilic material, and by application of functionalized micro/nanoparticles to the hydrophilic material. Substitution of hydrophobic material for the hydrophilic material creates a superhydrophobic surface. Further addition of an omniphobic coating to the functionalized micro/nanoparticles creates a durable omniphobic surface.

31 Claims, 17 Drawing Sheets

(56) References Cited

OTHER PUBLICATIONS

Burleigh et al., "Properties of nanoporous anodic oxide electrochemically grown on steel in hot 50% NaOH", JES, 156, 1, C45-C53, 2009 (Year: 2009).*
Hohne et al., "Superhydrophobic alumina surfaces based on polymer-stabilized oxide layers", Macromol. Chem. Phys, 2009, 210, 1263-1271 (Year: 2009).*
Leng et al., "Superoleophobic cotton textiles", Langmuir, 2009, 25, 2456-2460. (Year: 2009).*
Crick et al., "Preparation and characterization of superhydrophobic surfaces", Chemistry, A European Journal, 2010, 16, 3568-3588. (Year: 2010).*
Tsujii et al., "Super Oil-Repellent Surfaces", Angew. Chem. Int. Ed. Engl., 1997, 36, No. 9. (Year: 1997).*
Brenov et al., "Fabrication of anisotropic super hydrophobic/hydrophilic nanoporous membranes by plasma polymerization of C4F8 on anodic aluminum oxide", JES, 151, B484, 2004. (Year: 2004).*
Tuteja et al., "Robust omniphobic surfaces", PNAS, 18200-18205, 105, 47, 2008. (Year: 2008).*
Liu et al., "A microfluidic chip with poly(ethylene glycol) hydrogel microarray on nanoporous alumina membrane for cell patterning and drug testing", Sensors and Actuators B, 2010, 776-783. (Year: 2010).*
Sulka, "Nanostructures Materials in Electrochemistry", Chapter 1, "Highly ordered anodic porous alumina formation by self-organized anodizing", 2008. (Year: 2008).*
Jani et al., "Dressing in Layers: Layering Surface Functionalitities in Nanoporous Aluminum Oxide Membranes", Angewandte Chemie, 2010, 49, 7933-7937. (Year: 2010).*

* cited by examiner

| | Water contact angle |
|---|---|
| Unanodized, no coat | 59.1° |
| Anodized, no coat | 22.2° |
| Anodized, fluorosilane coat | 139.8° |

hydrophilic hydrophobic

METHODS OF MANIPULATING SURFACES FOR EXTREME HYDROPHILIC, HYDROPHOBIC OR OMNIPHOBIC BEHAVIOR AND APPLICATIONS THEREOF

This application is a continuation of U.S. Ser. No. 14/859,238, filed Sep. 18, 2015, which is a continuation of U.S. Ser. No. 13/951,065, filed Jul. 25, 2013, which claims the benefit of U.S. Provisional Application No. 61/675,634, filed Jul. 25, 2012, each of which is hereby incorporated by reference in its entirety as if fully set forth herein.

This invention was made with Government support under Contract N00014-09-C-0177 awarded by the Office of Naval Research (ONR). The Government has certain rights in this invention.

BACKGROUND OF THE INVENTION

Surface protection, corrosion and erosion resistance, and wide temperature/pressure stability are usually obtained by modifying the surface using coating technology. Coatings applied to protect the surface could be polymer, metallic or inorganic based coatings. These types of coatings can be achieved, for example, via chemical bath deposition, electrochemical deposition, spray painting, brushing, sputtering, etc. depending on the nature of the substrate that is to be coated and the type of coating.

Wetting of any surface by liquid is dependent on the intermolecular forces between the surface and the liquid. Adhesive forces between the liquid and the surface can cause the liquid to spread across the surface and the cohesive forces within the liquid can cause the liquid to ball up and avoid the surface. Based on the nature of the surface and of the liquid, the contact angle between the surface and liquid could range from 0 to 180°. In case of water-based liquids interacting with a surface, the surface is termed hydrophobic (water repelling) if the water contact angle ranges from 90 to 180°, where 180° suggests the surface is extremely hydrophobic and the liquid forms a spherical droplet. A surface is hydrophilic (water loving) if the water contact angle is <90°, and when the contact angle approaches 0° the surface becomes extremely hydrophilic and shows a high degree of wetting as evidenced by the spreading of liquid. If a surface repels any fluids, gas, solid particles or any combination thereof, then it is termed omniphobic.

Most hydrophobic coatings use nonpolar molecules, such as poly oligomeric silsesquioxanes (POSS), fluorinated acrylics, epoxies or hydrophobic silanes coated on surfaces to reduce surface energy and drag resistance. Those nonpolar molecules have very limited ability to create surface roughness or achieve low surface energy, and have physical limits to how much reduction in wettability (increased water contact angle) can be achieved with such coatings alone.

Needs exist for new and better-philic and -phobic coatings and coating processes.

SUMMARY OF THE INVENTION

This invention in embodiments provides a novel coating technology and surface chemistry to modify surfaces and make them extremely hydrophilic, hydrophobic or omniphobic. This technology is ideal for objects and surfaces of any shape, size and geometry, such as walls of pipes, boilers, pumps, valves, joints, and other metallic and/or metal alloy components.

One of the major applications of this technology is in upstream, midstream and downstream applications in the oil and gas industries. The new coating technology involves creating nanostructure morphology by electrochemical oxidation, etching, and/or chemical etching, followed by etching, chemical treatment, and/or electrochemical oxidation, and coating with a self-assembled monolayer or multi layers of organic, polymer, and/or inorganic molecules. The nature of surface modification and the following chemical treatment and/or functionalization determines the hydrophilic, hydrophobic or omniphobic properties of the surfaces. These new surfaces are very effective to reduce hydrate formation on the inner wall of oil and gas pipelines, inhibit corrosion, effect heat exchange and reduce friction and drag.

Embodiments of the invention apply to surface modification and protection processes for metals, alloys, ceramic components, etc. for use in harsh environmental conditions, such as extreme temperature and pressure conditions and in marine and corrosive (acidic or basic) environments.

There are several advantages of this approach over the existing prior art. In various embodiments, the new surface modification:

1) creates a unique nanostructure by a simple process which yields extreme hydrophilic, hydrophobic, or omniphobic surface properties;
2) is applicable to a wide range of materials such as metals, alloys, polymers, ceramics, etc.;
3) provides good control over the thickness and the uniformity of the coating, leading to long term durability of the coating;
4) is equally applicable to straight and curved surfaces and to irregular geometries; and
5) has consistent performances in all sorts of challenging environments, including a wide range of pressures (for example, up to 20,000 psi) and temperatures (for example −50° to 200° C.), varying pH (for example 0 to 14), etc.

The new invention has use and application in many areas including the following:

1) oil and gas industry,
2) construction,
3) aerospace,
4) marine,
5) manufacturing industries,
6) energy and electronic industries and
7) biomedical devices.

Technical problems that embodiments of the invention solve include:

1. providing on demand extreme hydrophilic, hydrophobic, and/or omniphobic surfaces on objects of any shape and any size and hard to coat areas in machines, engines, pumps, pipes, valves, etc. and
2. providing highly durable and scalable coating technology.

Embodiments of the new invention create highly-philic or -phobic coatings on highly textured surfaces formed by electrochemical oxidation (anodization), etching, and covering with a uniform monolayer or multi layers of ultra-phobic or ultra-philic molecules. In some embodiments, the uniform monolayer or multi layers of molecules are nanoparticles, which are covalently boned to the highly textured surfaces that are formed after electrochemical oxidation (anodization) and etching of such surfaces, for example by siloxane bonds (Si—O) or amide bonds ($CO—NH_2$).

These and further and other objects and features of the invention are apparent in the disclosure, which includes the above and ongoing written specification, as well as the drawings.

DETAILED DESCRIPTION

Figure 1:
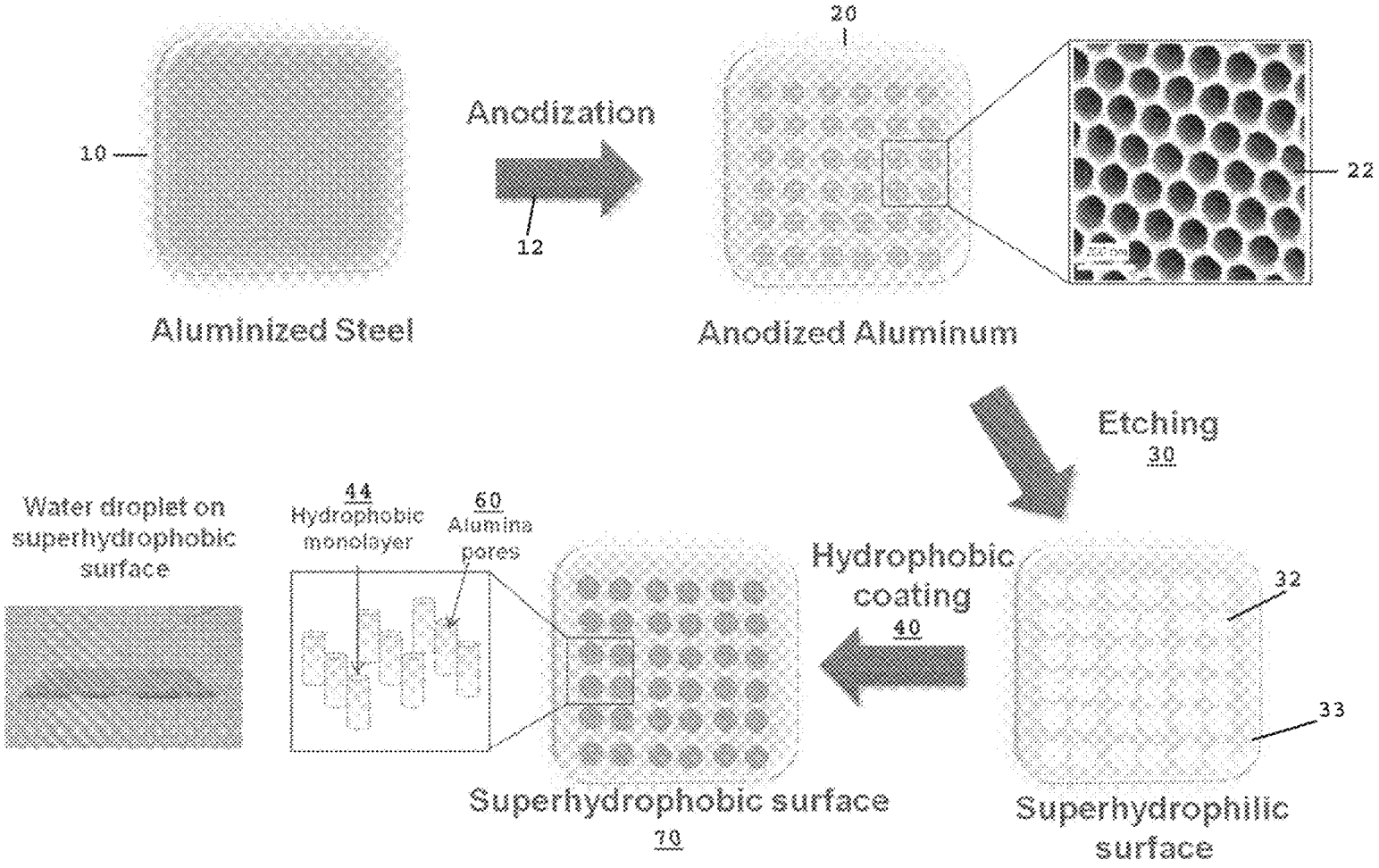
FIG. 1 is a schematic representation of the surface modification for a new hydrophobic coating process, according to an embodiment of the invention.

Methods of manipulating surfaces for extreme wetting hydrophilic, hydrophobic or omniphobic behavior and applications thereof will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. Any signal arrows in the drawings/figures should be considered only as exemplary, and not limiting, unless otherwise specifically noted.

The description is not to be taken in a limiting sense, but is made merely for the purpose of illustrating the general principles of the invention, since the scope of the invention is best defined by the appended claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items. As used herein, "at least one of A, B, and C" indicates A or B or C or any combination thereof. As used herein, the singular form of a word includes the plural, and vice versa, unless the context clearly dictates otherwise. Thus, the references "a", "an", and "the" are generally inclusive of the plurals of the respective terms.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

As used herein, ranges are used herein in shorthand, so as to avoid having to list and describe each and every value within the range. Any appropriate value within the range can be selected, where appropriate, as the upper value, lower value, or the terminus of the range.

The words "comprise", "comprises", and "comprising" are to be interpreted inclusively rather than exclusively. Likewise the terms "include", "including" and "or" should all be construed to be inclusive, unless such a construction is clearly prohibited from the context. The terms "comprising" or "including" are intended to include embodiments encompassed by the terms "consisting essentially of" and "consisting of". Similarly, the term "consisting essentially of" is intended to include embodiments encompassed by the term "consisting of". Although having distinct meanings, the terms "comprising", "having", "containing' and "consisting of" may be replaced with one another throughout the description of the invention.

"About" means a referenced numeric indication plus or minus 10% of that referenced numeric indication. For example, the term about 4 would include a range of 3.6 to 4.4. All numbers expressing quantities of ingredients, reaction conditions, and so forth used in the specification are to be understood as being modified in all instances by the term "about." Accordingly, unless indicated to the contrary, the numerical parameters set forth herein are approximations that can vary depending upon the desired properties sought to be obtained. At the very least, and not as an attempt to limit the application of the doctrine of equivalents to the scope of any claims, each numerical parameter should be construed in light of the number of significant digits and ordinary rounding approaches.

Wherever the phrase "for example," "such as," "including" and the like are used herein, the phrase "and without limitation" is understood to follow unless explicitly stated otherwise.

Embodiments of the invention create hydrophilic, hydrophobic, or omniphobic surfaces. FIG. 1 is a schematic representation of a new hydrophobic coating process. An aluminum sheet 10 is electrochemically oxidized 12, producing an electrochemically oxidized aluminum 20 having nanostructures 22. The electrochemically oxidized aluminum 20 with nanostructures 22 is etched 30, rendering a superhydrophilic surface. In some embodiments, the electrochemical oxidation and etching steps are repeated one or more times. Repeated oxidation and etching creates more uniform nanostructures on the surface. Creating nanostructures in the surface by oxidizing and etching the surface causes the surface to become superhydrophilic. The etched aluminum 33 with the etched nanostructures 32 is coated 40 with a monomolecular layer of hydrophobic molecules 44 on the sheet and in the nanostructures 60 to chemically functionalize it. A superhydrophobic surface 70 results.

The electrochemical oxidizing and etching steps physically functionalize the metal substrate and provide hydrophilic surface 33. In another example embodiment, the same electrochemical oxidizing and etching steps 12, 30 are used before applying a hydrophilic monomolecular layer (instead of the hydrophobic molecules 44) to produce a hydrophilic coating and surface.

Figure 2A:
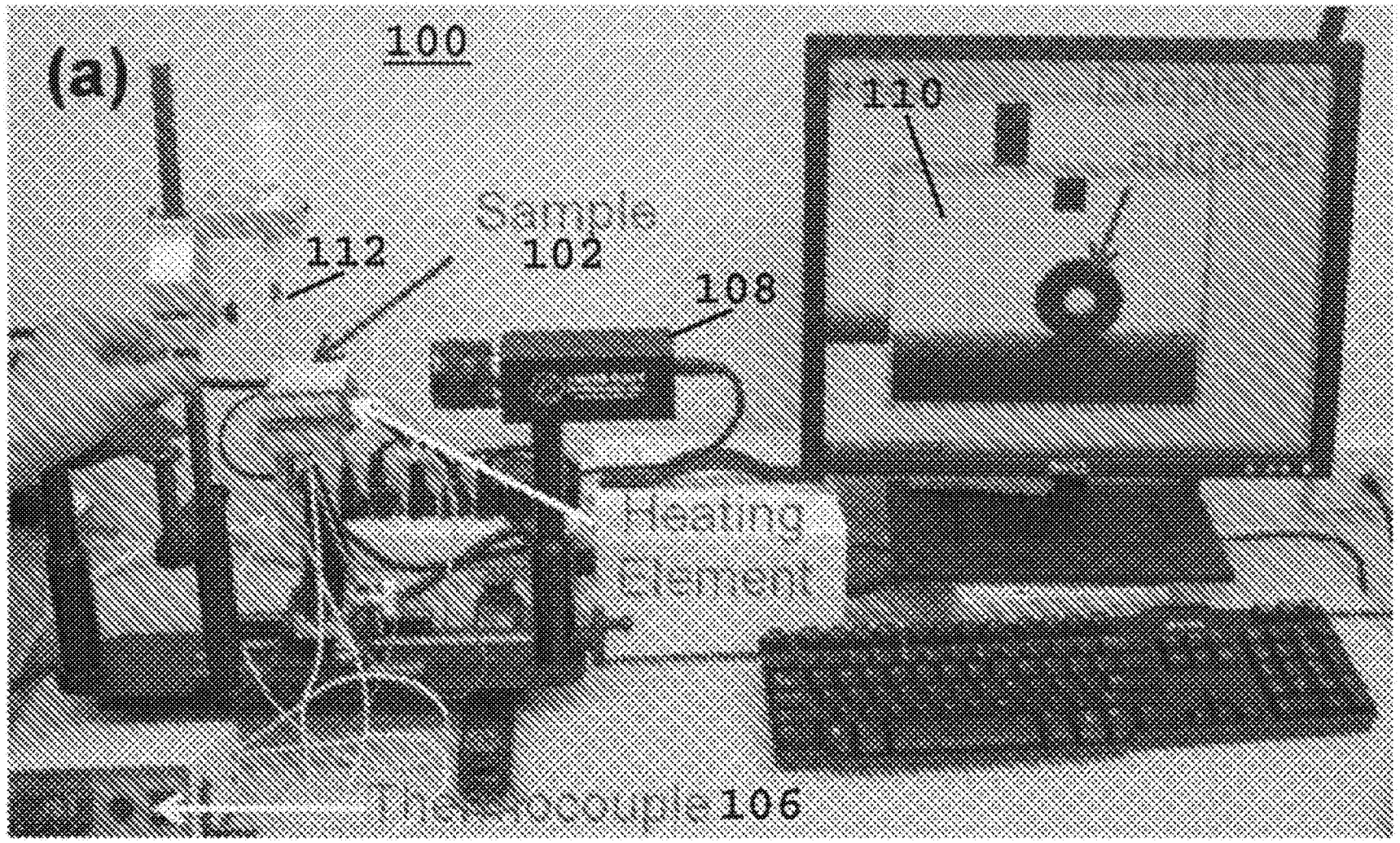
FIG. 2*a* is a photograph of the contact angle measurement set up.

FIG. 2*a* is a photograph of the contact angle measurement set up. FIG. 2*a* shows the contact angle measurement set up 100 with a sample 102, a heating element 104, a thermocouple 106 and a microscopic camera 108 to produce images 110 of a droplet dropped from a syringe 112 onto the new surface of the sample 102.

Figure 2B:
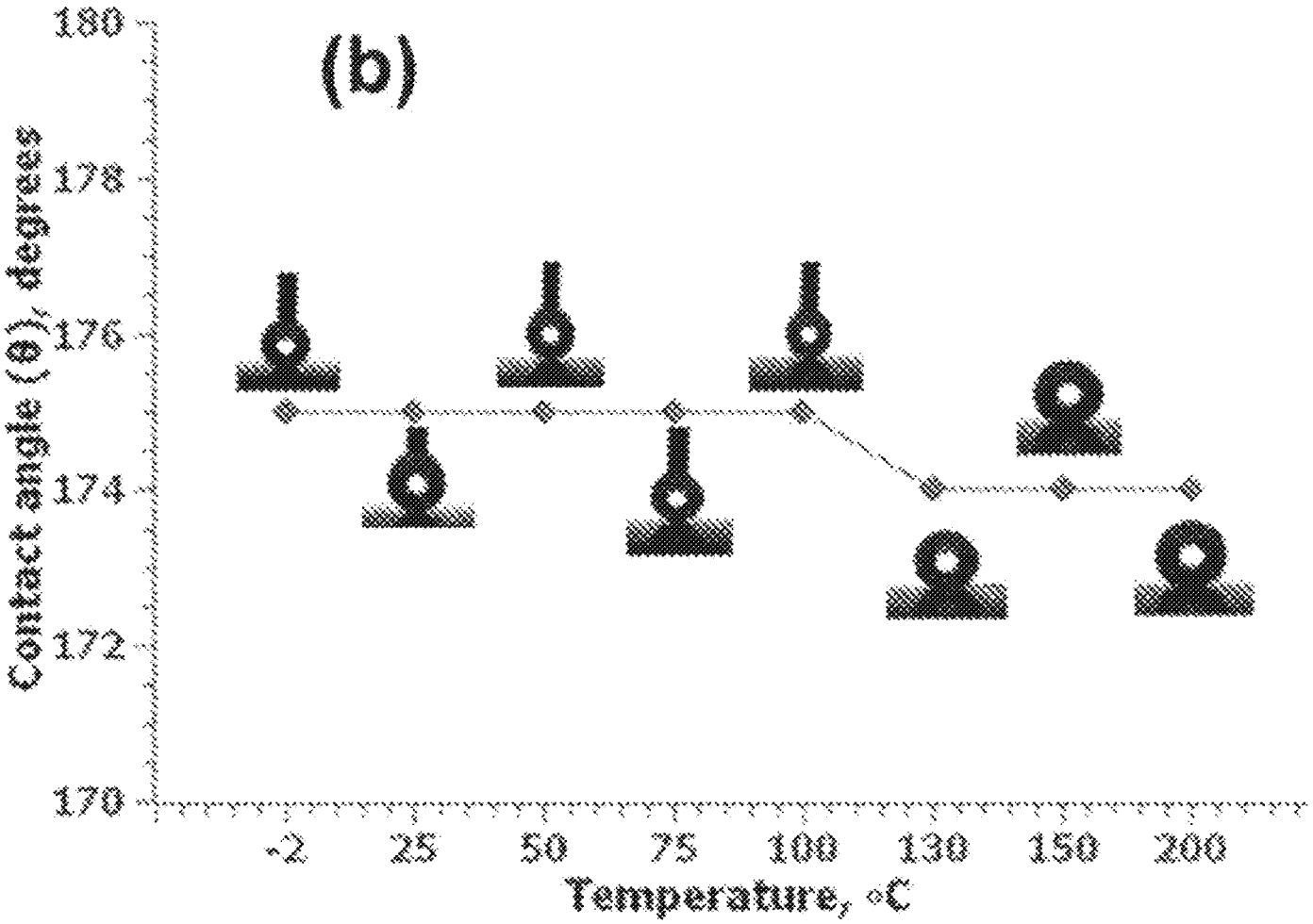
FIG. 2*b* is a chart of contact angle degrees at various temperatures for the new hydrophobic coating, according to an embodiment of the invention.

FIG. 2*b* indicates contact angles of a new hydrophobic coating created according to the process described with regard to FIG. 1 at various temperatures, with two cycles of oxidation and etching (i.e. oxidizing, then etching, then oxidizing again, then etching again). The monomolecular layer of hydrophobic molecules in this example is 0.5 wt % fluorinated silane (Trichloro(1H, 1H,2H,2H-perfluorooctyl) silane in hexane. The contact angles of water droplets on the new hydrophobic surface were measured at several temperatures of the sample surface. The contact angle remains uniform at 175 degrees at stepped surface temperatures up to 100 degrees centigrade. The angle only slightly decreases to 174 degrees at surface temperature increases up to about 200° C., indicating that the surface is in fact a hydrophobic surface.

In addition to basic hydrophobic characterization, the drag coefficient, partial pressure developed and slip length of modified aluminum pipes having surfaces modified according to embodiments of the present invention were determined. The values were determined following standard fluid dynamics measurement protocol reported in the literature. One of the most commercially viable properties of hydrophobic surfaces is their ability to reduce drag. Previous studies have shown drag reduction in micrometer scale channels. Micrometer scale channels are relatively simple structures to study and have numerous practical applications in fluid transport processes. For example, oil pipelines sometimes use an annular strip of water to reduce friction at the pipe walls and, therefore, reduce drag. Drag could be further reduced with a hydrophobic pipe wall according to the present invention.

Testing

In one study, 1-foot long pipes having different surface properties were studied. First, aluminum pipes modified with embodiments of the new invention according to the hydrophobic coating process described with regard to FIG. 1 were compared with uncoated aluminum pipes. The monomolecular layer of hydrophobic molecules used for all of these pipes was 0.5 wt % fluorinated silane (Trichloro(1H, 1H,2H,2H-perfluorooctyl)silane in hexane. The flow rate of tap water through the pipes (0.1 L/min to 1.6 L/min) was varied, and pressure differences across the pipes were recorded. Second, different treatment processes of the present invention were studied, which allow determinations of how these differences in surface features and structure change the way the pipes reduce drag. A schematic and the photograph of the test set up used for the testing purposes are shown in FIGS. 3*a* and 3*b*, respectively.

Figure 3A:
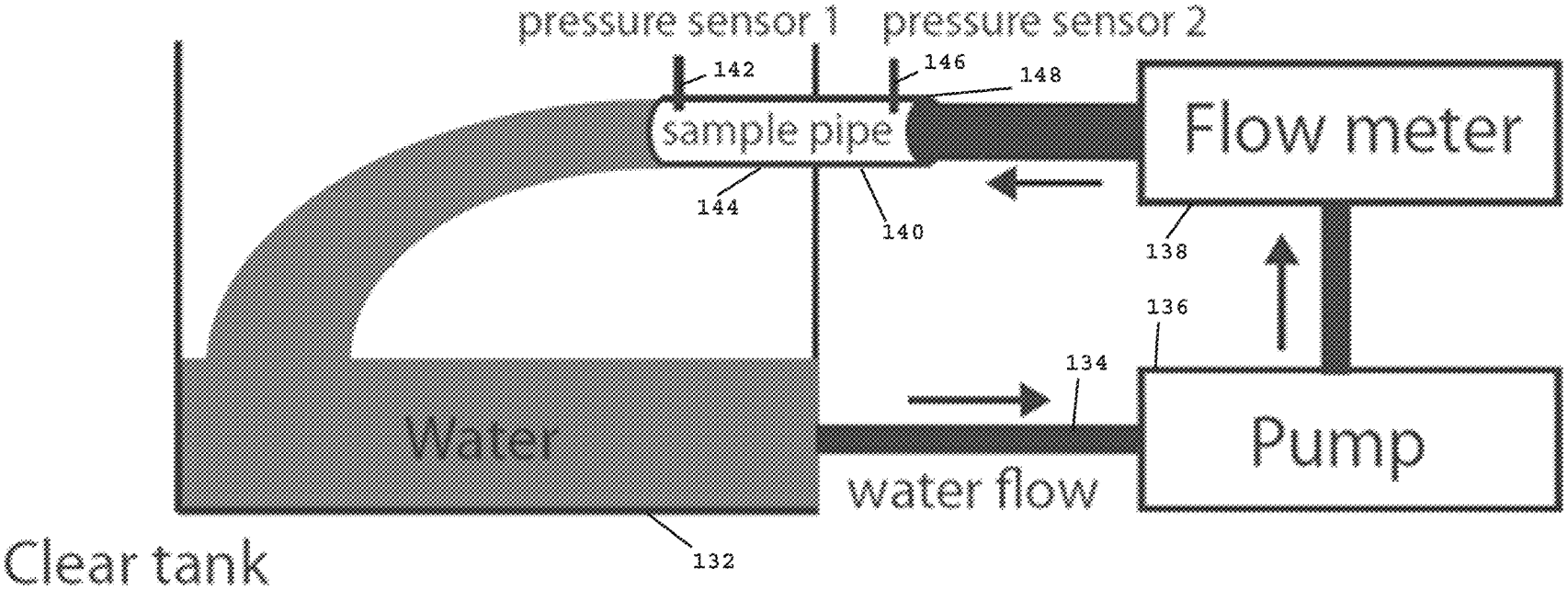
FIG. 3*a* is a schematic of the test set up for testing pressure drop in pipes with different surface properties.

As shown in FIG. 3*a*, water from a clear tank 132 flows 134 to a pump 136. Pump 136 pumps the water through a flow meter 138 and through a pipe 140 back into the tank 132. Pressure is sampled by a first pressure sensor 142 at a discharge end 144 of the pipe 140. Pressure is also sampled by a second pressure sensor 146 at an inlet end 148 of pipe 140.

Figure 3B:
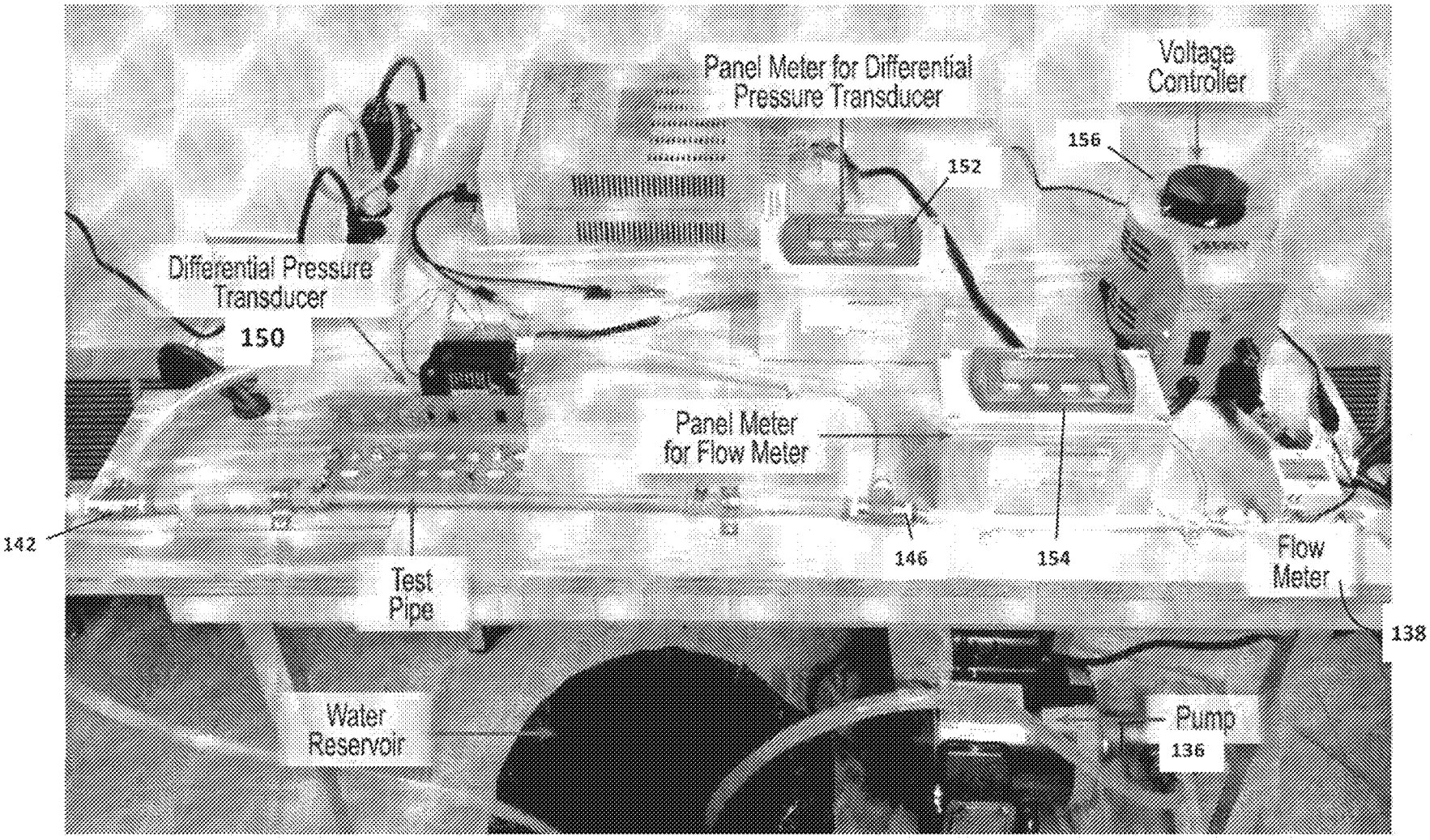
FIG. 3*b* shows a photograph of the test set up for testing pipes with different surface properties.

The same elements are shown in FIG. 3*b* with the actual addition of a pressure differential transducer 150, connected to pressure sensors 142 and 146. A panel meter 152 is connected to the pressure differential transducer, 150. A panel meter 154 is connected to the flow meter 138. A voltage controller 156 is connected to pump 136.

Table 1 provides the various process conditions followed for fabricating the pipes for testing. The tested pipes had a length of 1 foot, and an internal diameter of ⅛ inch.

TABLE 1

List of process conditions followed for making various pipes.

| Pipe | Surface Description | Soak Time Sodium Hydroxide (min) | Max Percent Drag Reduction (%) |
|---|---|---|---|
| 1 | 0.3 M, 10 hrs | <3 | Not Significant |
| 2 | 0.3 M, 2 hrs | <3 | Not Significant |
| 3 | 0.6 M, 5 hrs | <3 | 26.3 |
| 4 | 0.6 M, 12+ hrs | <3 | 34.4 |
| 5 | 0.6 M, 5 hrs | 3 | 22.17 |

"Surface Description" indicates the duration of electrochemical oxidation (anodization) and the concentration of oxalic acid used for the anodization, in the process described in FIG. 1, a process which has one oxidation step and one etching step. "Soak Time Sodium Hydroxide (min) indicates the time for which the surface was etched in sodium hydroxide, as shown in step 30 of FIG. 1. "Max Percent Drag Reduction (%)" indicates the maximum drag reduction achieved by the pipe in the testing. 0.5 wt % fluorinated silane (Trichloro(1H, 1H,2H,2H-perfluorooctyl)silane in hexane hydrophobic coating was applied to each.

Figure 4:
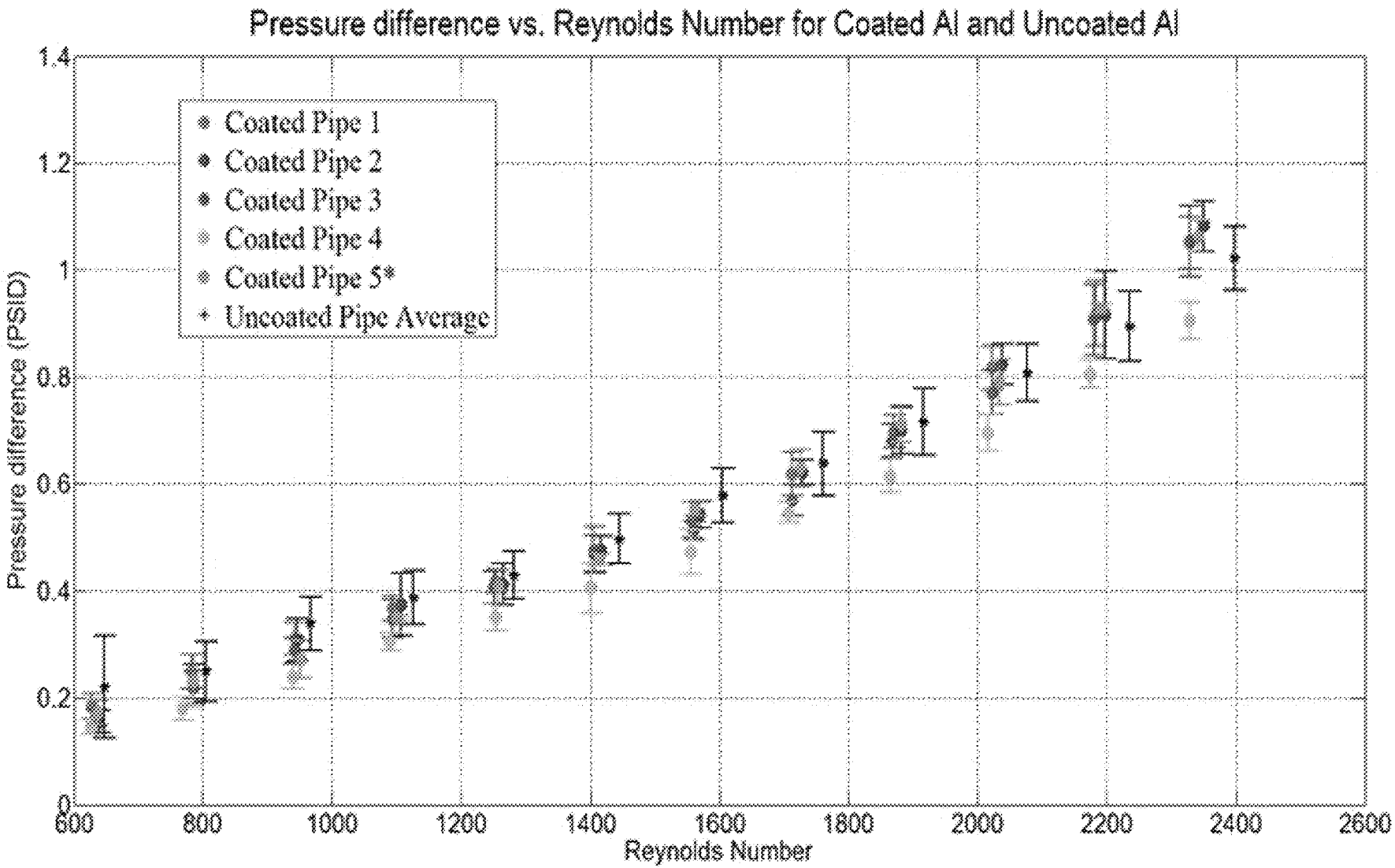
FIG. 4 is a graph showing pressure difference (PSID) versus Reynolds number (Re) for aluminum pipes coated with new coatings according to embodiments of the invention and uncoated aluminum pipes.

FIG. 4 is a graph showing pressure difference (PSID) versus Reynolds number (Re) for Table 1 coated aluminum pipes 1, 2, 3, 4, 5 and an uncoated aluminum pipe.

Figure 5:
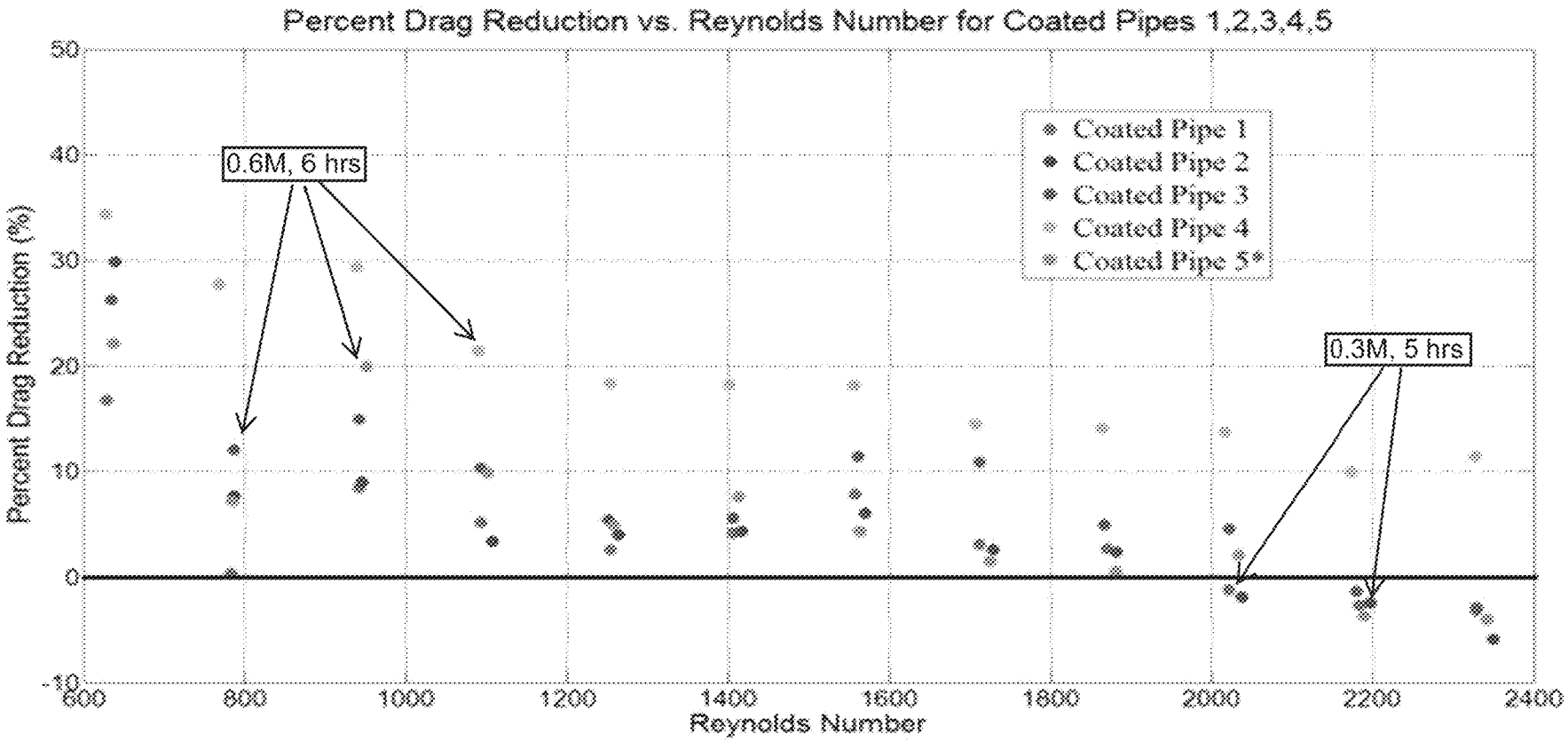
FIG. 5 is a graph showing percent drag reduction versus Reynolds number for aluminum pipes coated with the new coatings, according to embodiments of the invention.

FIG. 5 is a graph showing percent drag reduction versus Reynolds number for Table 1 coated aluminum pipes 1, 2, 3, 4, 5.

Based on the experimental process conditions shown in Table 1, coated pipe 4 that was prepared using 0.6M oxalic acid for 12 hrs of electrochemical oxidation (anodization) achieved a significant pressure drop of 0.8 PSI (FIG. 4) that corresponds to 34% reduction in drag force (FIG. 5).

The coated hydrophobic pipes were found to have significant drag reduction (>14%), with the largest drag reduction measurement being 34.4% for pipe 4. In addition, it was found that the drag reduction of a hydrophobic pipe is directly related to the density of its surface pores. With a higher pore density, there is generally more drag reduction. Pore density is measured as the percentage of the surface taken up by the pores. With cylindrical pores, there is a geometric maximum pore density at the point where the pores would intersect and merge. Pore density is preferably 50% or less. Greater than 50% pore density may result in reduced drag reduction. In some preferred embodiments, pore density is 30-40%. The pore diameter is a function of solution concentration and voltage/current/temperature in the anodization process, and depth of the pores are based on the duration of oxidation and etching. Higher concentrations result in larger pore diameters, and longer treatment duration result in deeper pores and therefore a thicker modified surface layer. Pores are preferably 1-20 microns in depth. In some embodiments, the pores are greater than 5 microns in depth. A diameter of up to 200 nm is preferred. Deeper pores are generally preferable. Larger pores have larger air pockets within them, which makes the surface more hydrophilic, increasing wettability as water flows into the pores. However, after the hydrophobic coating is applied on top of the surface with pores, resulting hydrophobicity is greater for larger pores, with better adherence of the hydrophobic coating and with the coating making up a larger percentage of the volume of the modified surface layer, reducing drag on the surface from water flows.

Anti-Icing Properties of the New Coated Aluminum

In addition, cold weather testing of new-coated hydrophobic aluminum 160 was conducted. This aluminum was prepared by the procedure described above with regard to FIG. 1, wherein the oxidation and etching steps (electrochemical oxidation followed by chemical etching) were performed twice, followed by application of the hydrophobic coating 0.5 wt % fluorinated silane (Trichloro(1H, 1H,2H,2H-perfluorooctyl)silane in hexane.

3"×5" aluminum coupons, plain 162, hydrophilic-coated (not shown) and hydrophobic 160 coated were subjected to testing to determine their ability to survive in ice, snow and subzero temperatures. The tests were conducted for a period of 6 weeks.

Figure 6A:
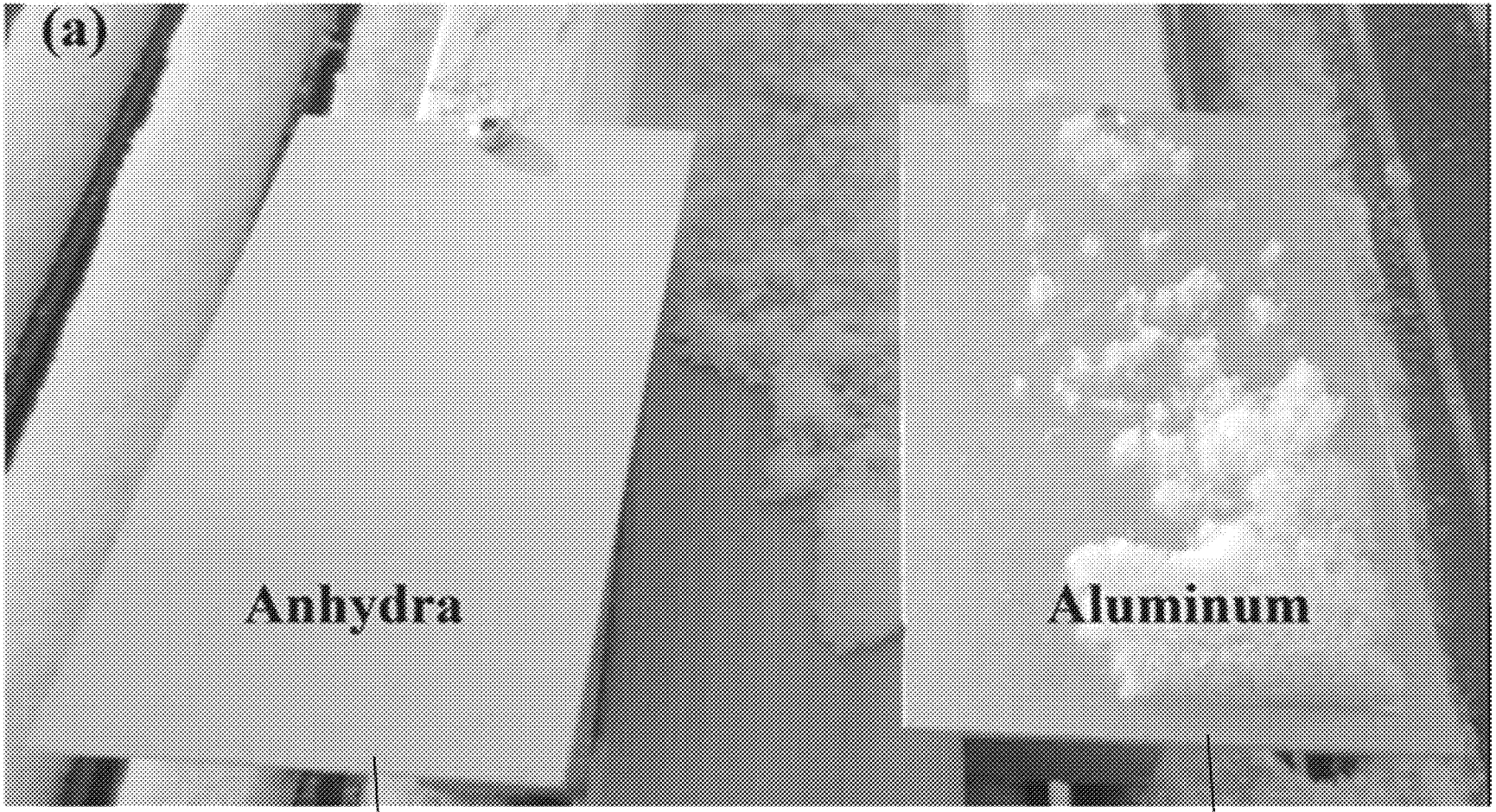
FIG. 6*a* is a photograph showing snow accumulations for the new coated aluminum according to an embodiment of the invention and bare aluminum placed on low slopes.
Figure 6B:
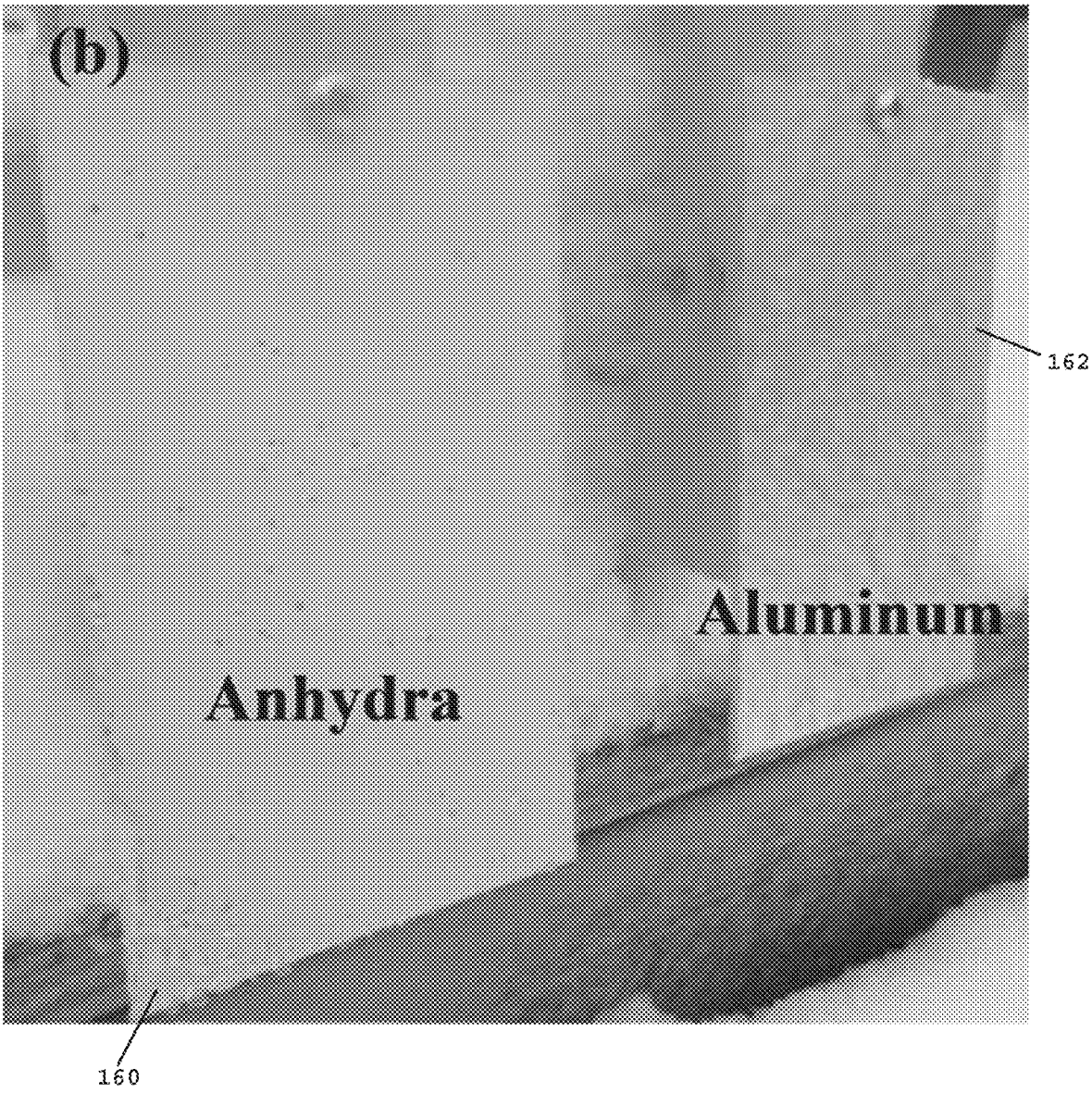
FIG. 6*b* is a photograph showing rain and snow accumulations for the new coated aluminum according to an embodiment of the invention and bare aluminum placed on steep slopes.
Figure 6C:
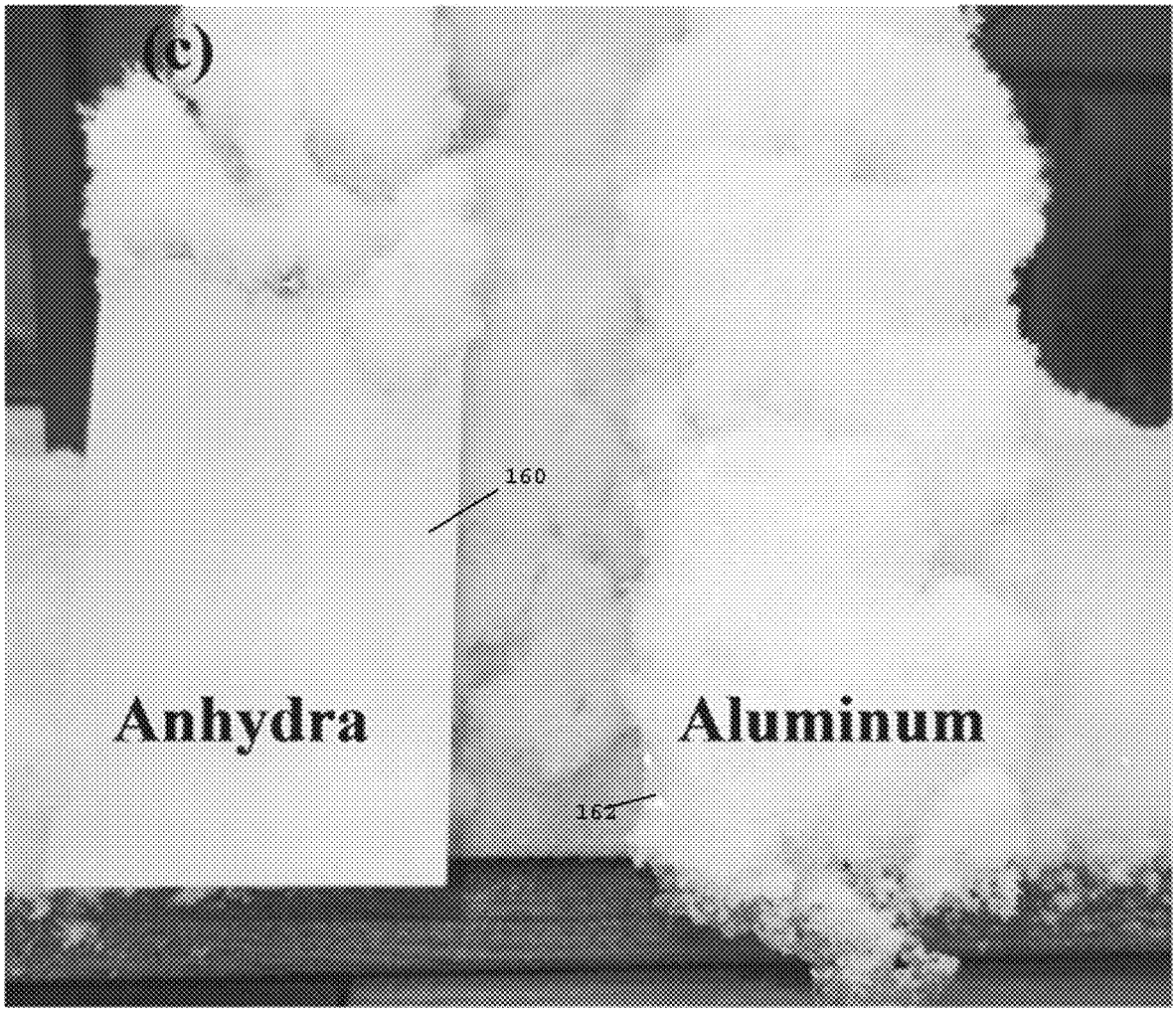
FIG. 6*c* is a photograph showing heavy snowfall accumulation for the new coated aluminum according to an embodiment of the invention and bare aluminum placed on steep slopes.

The new coated aluminum 160 and bare aluminum 162 coupons were placed on both a low slope and a steep slope and allowed to accumulate snow. The coupons were then photographed to visualize the snow accumulated as shown in FIGS. 6*a-c*. As seen from FIG. 6*a* in low slope conditions, there was no snow accumulation on the new coated aluminum 160 but there appears to be considerable accumulation on the bare aluminum 162. As shown in FIGS. 6*b* and 6*c*, when samples were tested on a steep slope, very minute amounts of snow/ice droplets similarly accumulated on the new coated aluminum 160 compared to significant accumulation on bare aluminum 162.

Hydrophilic aluminum did not survive the cold weather test, had significant snow accumulation and upon thawing experienced pitting corrosion. Ice and snow droplets on the surface of the new hydrophobic coated aluminum 160 rolled off upon thawing and caused no damage to the surface. The results clearly indicate that the new coated surfaces are extremely hydrophobic and ice repellent and show superior durability in combinations of snow, ice, and rain.

FIGS. 6*a-c* label the hydrophobic coated aluminum 160.

Process for Fabricating Hydrophilic/Hydrophobic Steel Surface

Figure 7:
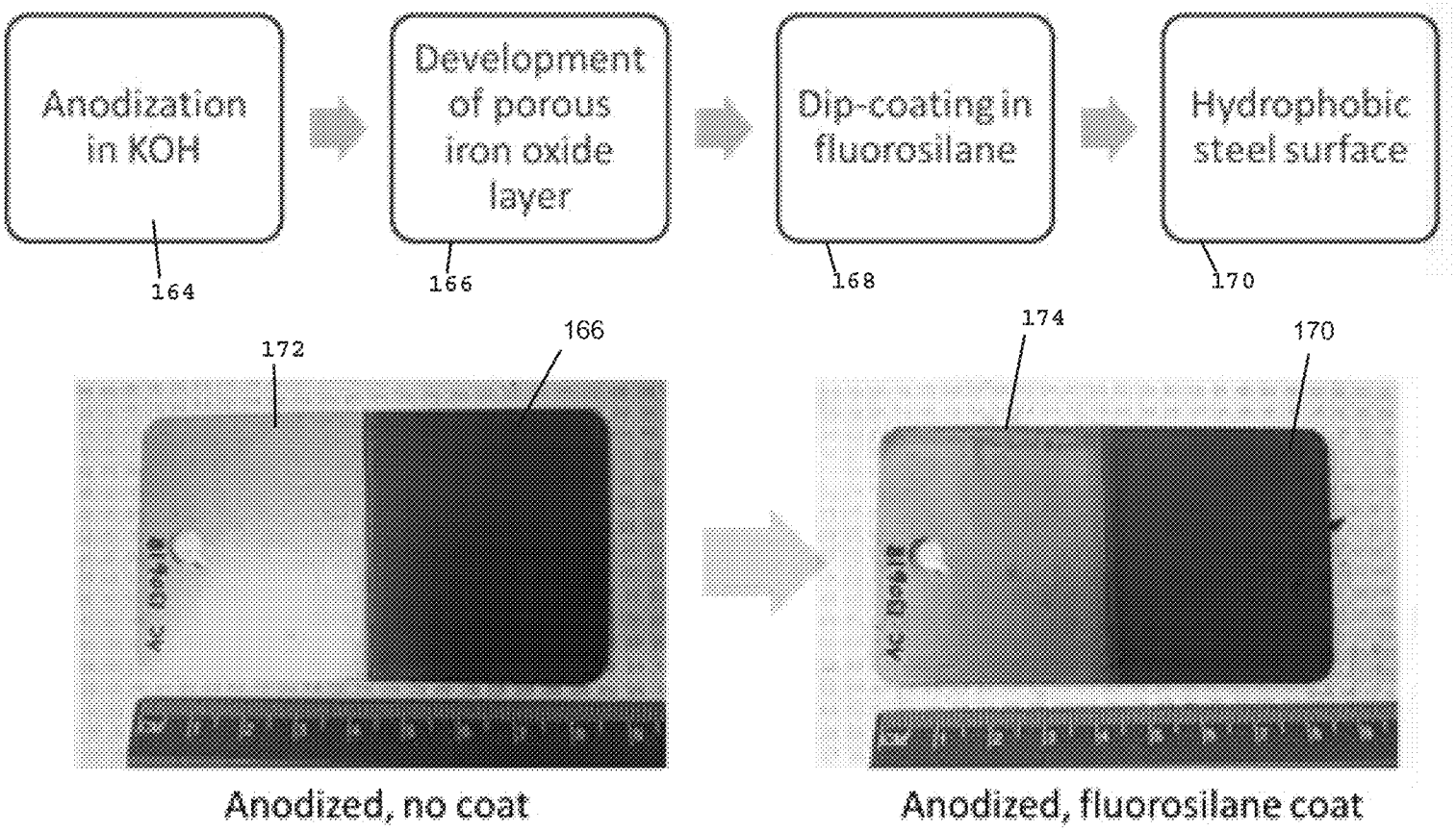
FIG. 7 is a representation of steps in a schematic process for fabricating hydrophobic steel surfaces, with photographs of uncoated electrochemically oxidized (anodized) and fluorosilane coated electrochemically oxidized (anodized) specimens.

In another embodiment of the present invention, the new coating process was modified to produce steel with hydrophobic surfaces. FIG. 7 shows a schematic process for fabricating hydrophobic steel surfaces.

A steel sheet is electrochemically oxidized (anodized) in KOH 164, developing a porous iron oxide layer 166. The electrochemically oxidized steel sheet 172 is then dip-coated in fluorosilane 168 yielding a fluorosilane coated electrochemically oxidized steel sheet 174 with a hydrophobic steel surface 170. NaOH can be substituted for KOH in this process.

Figure 8:
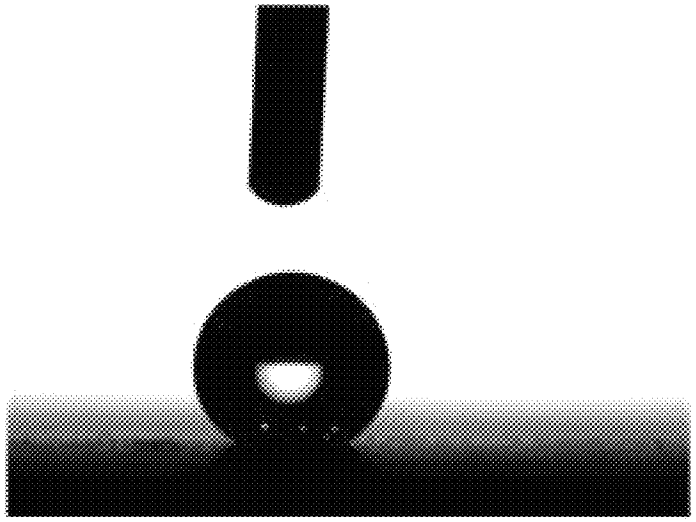
FIG. 8 is a chart showing water contact angles of bare steel, electrochemically oxidized, and electrochemically oxidized and fluorosilane coated specimens and a photo diagram of a water droplet and a water contact angle, showing high water repellency at a water contact angle achieved in another embodiment of the present invention, wherein the new process modifies steel to produce steel with hydrophobic surfaces.

Through the new process, FIG. 8 shows that high water repellency and a water contact angle of ~140° were achieved. The electrochemically oxidized steel with no fluorosilane coating 172 shows significant reduction in water contact angle and is extremely hydrophilic compared to untreated steel and improves the binding/adhesion between bare steel and cement, for example for rebar, pipes, or any steel structure that is in contact with cement or concrete.

Omniphobic Coating Process

Figure 9:
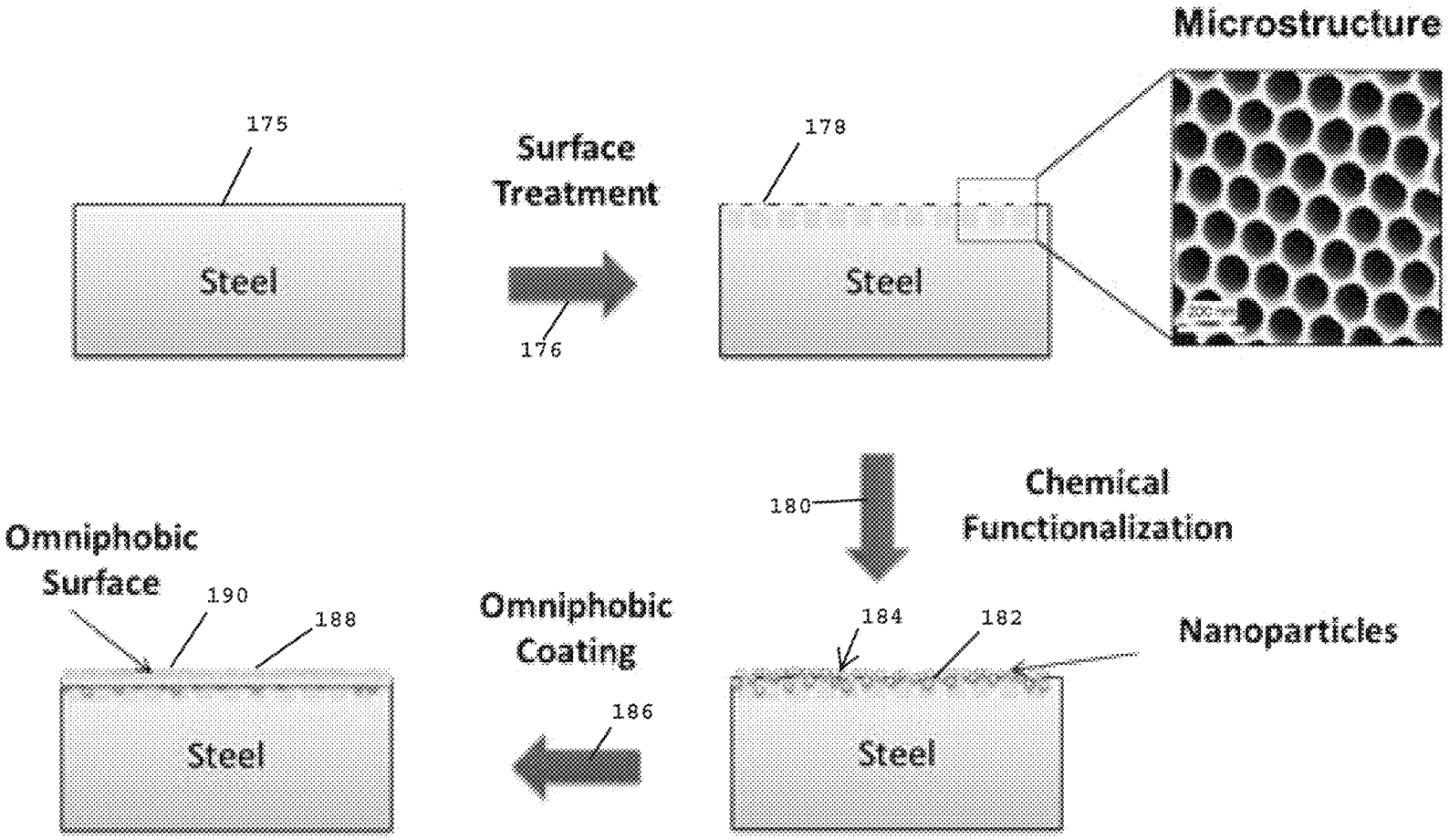
FIG. 9 is a schematic representation of steel surface treatment in an omniphobic coating process of the invention to achieve a high surface roughness and a uniform low surface energy coating.
Figure 10:
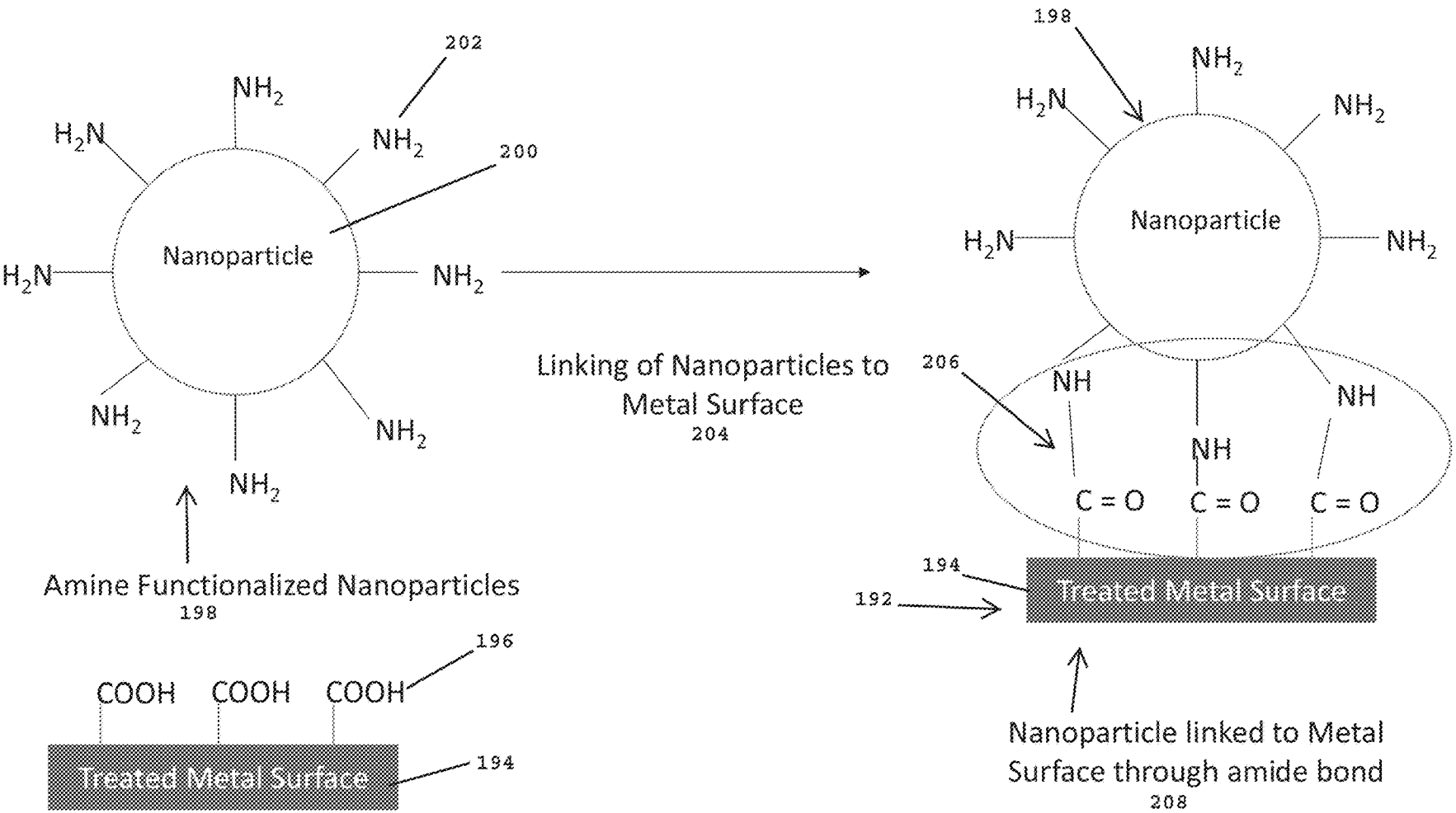
FIG. 10 is a schematic representation of the bonding of functionalized nanoparticles to a chemically functionalized metal surface, according to some embodiments of the present invention.

In nature there are few surfaces that are both hydrophobic (water repelling) and lipophobic or oleophobic (oil repelling). Poly tetra fluoro ethylene (PTFE) or Teflon is the most commonly available omniphobic material. This material suffers from poor thermal and mechanical strength and is expensive for use in oil and gas applications. In order to achieve extreme repellency, the two-step coating process shown in FIG. 1 is further refined to achieve high surface roughness and a uniform low surface energy coating. A schematic of this refined omniphobic coating process and approach is shown in FIG. 9. In one example of a surface treatment 176, electrochemical etching is used to prepare highly nano/micro porous surfaces 178 on the steel surface 175 (in other embodiments, the surface may be aluminum, etc.). The nanoporous surface 178 is chemically functionalized 180, then coated with a thin layer of micro and nanoparticles 182 with functional groups to anchor onto the surface of the chemically functionalized steel. For example, the micro and/or nanoparticles 182 may be functionalized with amines and the surface 178 may be functionalized 180 with carboxylic acid so that when the functionalized micro and nanoparticles 182 are applied to the functionalized surface, strong amide bonds are formed adhering the microparticles and nanoparticles 182 to the surface 178, as shown in FIG. 10. Attachment of particles 182 to the surface 178 of the steel through chemical crosslinking functional groups is permanent and enhances the adhesion of the particles to the nanoporous surface 178. The micro and/or nanoparticles 182 create texture for subsequent application of the omniphobic coating 186.

Once the highly micro-textured surface 184 is achieved by the nanoparticle attachment to the steel surface through chemical functionalization 180, it acts as the base for the omniphobic coating 188. Note that, prior to application of the omniphobic coating 188, highly micro-textured surface 184 is hydrophilic. The modified surface 184 is coated with low surface energy non-polar molecules 188 such as perfluoro octyl trichloro silane, perfluoro octyl phosphonic acid, perfluorosiloxane, fluorohydrocarbon, fluorosilane, perfluorinated acid, amine, phosphoric acid, alcohol, ethers, sulfonate, or perfluoro polyhedral oligomeric silsesquioxanes (POSS), through a dip or spray coating process 186. The non-polar molecules 188 may in embodiments be non-polar monomers/prepolymers. The low surface energy non-polar molecules 188 uniformly cover the surface of the micro/nanoparticles 182 that are anchored on to the nanoporous steel surface 178. The perfluoro (or other) compounds 188 are wicked into the highly micro textured surface 184 and permanently physically attached to the nanoparticles 182 by a combination of surface tension and adhesive forces between the compounds 188 and surface 184, resulting in a very durable coating 188. The combination of a high surface roughness and the low surface energy coating results in an extreme water and oil repelling property. Application of the non-polar monomer/prepolymer coating without treating the underlying metal surface to create surface roughness results in a significantly lower contact angle with water droplets than application of the non-polar monomer/prepolymer coating with surface roughness treatment. The process of coating a highly micro textured surface as described can achieve a contact angle of as much as 120° or greater for both water and oil, whereas application of the coating to a surface without the roughness treatment can achieve a contact angle of 80°-90° for water and only 40°-60° for oil.

Thus, the omniphobic surface 190 provides a permanent and durable coating through chemical functionalization process 180 that has high abrasion and corrosion resistance from the high strength nanoparticles 182 used in the coating, and has low cost and is easily scalable on surfaces of different shapes and sizes. The nanoparticles used may be ceramic nanoparticles, such as silica, titania, or alumina, which have high compression strength and abrasion resistance. Since the surface treatment process (oxidation/etching) can be done by immersion of the object in the treatment solution, uniform coverage of the treatment solution is achieved. The chemical functionalization and/or the omniphobic coating may also be applied by immersing the object in solution. Thus, processes according to embodiments of the present invention are excellent for use on surfaces of all different shapes and sizes. In contrast, typical prior art coating applications involves spraying/brushing of coating, which often leads to non-uniform coating on intricately shaped surfaces and objects.

Figure 13:
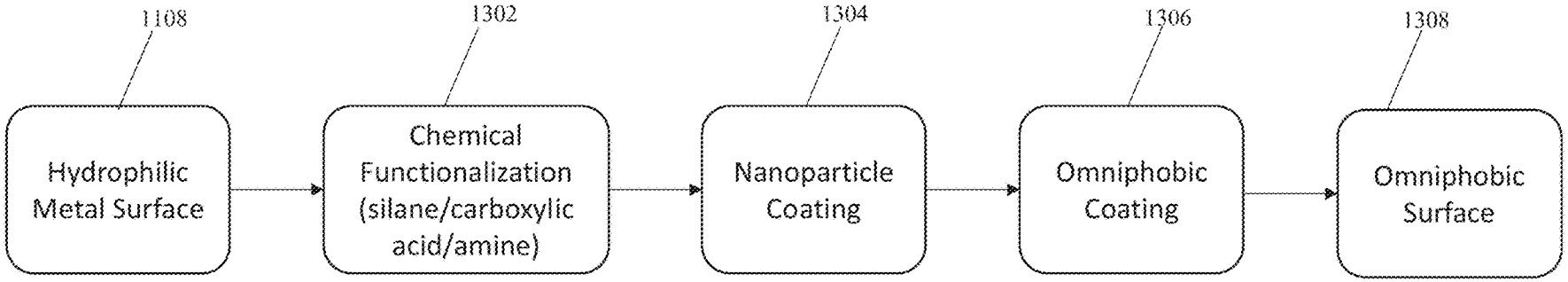
FIG. 13 is a flowchart illustrating a method of preparing an omniphobic surface, according to some embodiments of the present invention.

FIG. 13 is a flowchart more generically illustrating a method of preparing an omniphobic surface, according to some embodiments of the present invention. To create an omniphobic surface, first a hydrophilic surface 1108 is created by etching and oxidation 1106, 1108 as described below and with respect to FIG. 11. For purposes of ultimately creating an omniphobic surface, the oxidation may form an oxidized layer of between 50 nm and 1000 microns in thickness on the underlying material (e.g. metal, metal alloy, ceramic, or composite). The surface 1108 is then chemically functionalized 1302, for example as shown and described with respect to FIG. 11 with carboxylic acid, or with silane. Thereafter, functionalized micro and/or nanoparticles are applied 1304 to the surface to create a highly micro-textured surface.

Figure 11:
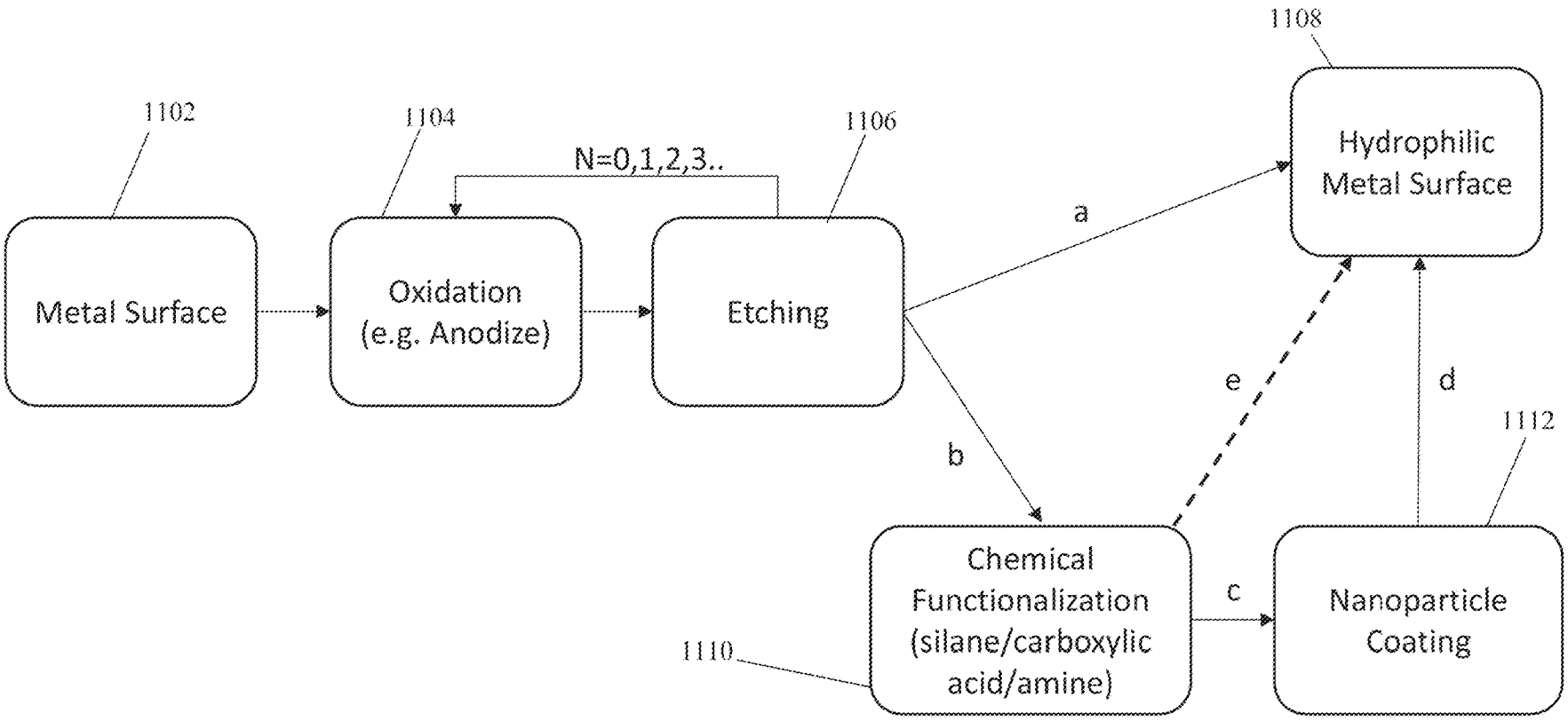
FIG. 11 is a flowchart illustrating a method of preparing a hydrophilic surface, according to some embodiments of the present invention.

One or more layers of low surface energy non-polar molecules (omniphobic coating 1306) are then applied to the surface having the attached micro and/or nanoparticles 1304. Thus, the creation of omniphobic surfaces according to some embodiments of the present invention begins with the process for creating the hydrophilic surfaces, in some embodiments (e.g. as shown in FIG. 11 and ending in nanoparticle coating 1112), and is completed with the addition of an omniphobic coating 1306.

The one or more layers of low surface energy non-polar molecules may be a monomolecular layer or layers of multiple molecular thickness. The one or more layers of low surface energy non-polar molecules may be drawn into and permanently attached to the microparticles and/or nanoparticles by physical properties such as adhesion and surface tension. The surface of the microparticles and/or nanoparticles may be uniformly covered with the low surface energy non-polar molecules. The low surface energy non-polar molecules may include perfluoro octyl trichloro silane, perfluoro octyl phosphonic acid, and/or perfluoro polyhedral oligomeric silsesquioxanes (POSS). The low surface energy non-polar molecules may include perfluorosiloxane, fluorohydrocarbon, fluorosilane, perfluorinated acid, amine, phosphoric acid, alcohol, ethers, and/or sulfonate. The low surface energy non-polar molecules may include non-polar monomers/prepolymers, which may include, for example, perfluoro silanes, poly oligomeric silsesquioxanes, perfluoro phosphonic acids, perfluoro hydrocarbons, halogenated hydrocarbons, hydrocarbons, and/or substituted hydrocarbons.

The omniphobic surface may be formed on an interior surface of a pipe, tube, valve, joint, pump or tank, and may reduce drag and improve the flow of water, oil, or other substances through the interior of the pipe, tube, valve, joint, pump or tank. The omniphobic surface may also be embedded in a matrix, such as concrete, polymer, ceramic or any other matrix.

Preparing Hydrophilic Surfaces

FIG. 11 is a flowchart illustrating a method of preparing a hydrophilic surface, according to some embodiments of the present invention. The process starts with a metal surface 1102, such as, for example, steel, aluminum, titanium, magnesium, niobium, tantalum, zinc, or an alloy of any of these. In other, otherwise analogous embodiments, the surface may be another material such as ceramic or polymer. A hydrophilic surface can be created on a metal, metal alloy, ceramic, polymer, or composite material by oxidizing 1104 and/or etching 1106 the material's surface to create nanostructures, such as nanopores, to give the surface roughness. As illustrated, oxidation and etching 1104, 1106 may be repeated one or more times to achieve desired pore dimensions (e.g. diameter, depth) and density. Nanopores formed by the oxidizing and/or etching may be in the range of 5 nm to 1,000 nm in pore diameter. Pore depth represents the thickness of the oxidized layer and may be 50 nm to 20 microns. For aluminum, pore depth is preferably 5 microns or greater. For other metals and/or metal alloys, expected pore depth would be on the order of 1-20 microns, depending on the duration of anodization. Regardless of the type of metal or metal alloy, the oxidizing may create an oxidized layer in the thickness range of 50 nm to 1,000 microns.

Examples of metals on which a hydrophilic surface can be created are aluminum, titanium, magnesium, iron, and nickel, as well as their alloys. The nanostructures create a hydrophilic surface 1108 on the material. The oxidation 1104 may involve exposing the material surface to an aqueous, non-aqueous, or ionic liquid oxidizing solution, heat treatment, laser treatment and/or anodization. Anodization of aluminum or an aluminum-based alloy may be performed with oxalic acid, at a concentration for example of 0.6 M, and for a duration of 5+ hours, for example 5 hours, 10 hours, 12 hours or more. For steel, potassium hydroxide or sodium hydroxide solution may be used as an oxidizing chemical. Sulfuric acid, hydrochloric acid, and chromic acid can be used for anodizing both aluminum and steel. Similar concentrations and durations may be utilized for each. The etching 1106 may be carried out, for example, chemically, for example by soaking in sodium hydroxide or potassium hydroxide, for example for three minutes or less. Hydrochloric acid and oxalic acid are options for chemical etching of steel. In some embodiments, oxidizing 1104 and etching 1106 may be performed repeatedly in alternating fashion as shown, for example until desired nanostructures are formed on the surface. Electrochemical oxidizing and/or chemical etching may be performed at a temperature of −10° C. to 75° C. The same parameters may be used for oxidation and etching in this process as are described above for the process of FIG. 1, which, if stopped prior to application of hydrophobic coating 40, results in a hydrophilic surface. Although the nanostructures give rise to a hydrophilic surface 1108 by themselves, in some embodiments hydrophilic properties may be enhanced by application 1110 of one or more layers of a hydrophilic material to the surface after the oxidation 1104 and/or etching 1106 steps. The hydrophilic material may include polar monomer/prepolymers containing amino acids, carboxylic acids, amines, sulfonates, sulfates, phosphates, acetates, borates, alcohols, thiols, nitriles, amides, aldehydes, and/or esters. The hydrophilic material may be applied by, for example, spray coating, screen printing, electrodeposition, dip coating and/or vacuum deposition. The hydrophilic material may adhere to the surface by covalent bonding, electrostatic attachment, or physisorption. The hydrophilic material may be applied as a monomolecular layer or as multiple layers.

The hydrophilic material is applied 1110 directly to the oxidized and/or etched surface, and may result in a desired hydrophilic surface 1108. If not, micro- and/or nano-particles may then be attached 1112 to the surface with functional groups to achieve the desired hydrophilic surface 1108. Micro and/or nanoparticles with functional groups are applied (for example by dip or spray coating) in a thin layer (i.e., less than 25 microns) to coat the nanoporous surface. The functional groups anchor the micro and/or nanoparticles to the surface by chemical crosslinking with the hydrophilic material on the surface, which results in permanent adhesion.

Permanent adhesion is characterized by chemical links between the hydrophilic coating and the micro and/or nanoparticles with functional groups that create a chemical bond between the coated (chemically functionalized) surface and the micro/nanoparticle layer. FIG. 10 illustrates an example of such a process. Treated hydrophilic metal surface 194 is etched and oxidized and has resulting surface nanostructures. The surface 194 has been chemically functionalized with carboxylic acid 196, which adheres to the nanostructured hydrophilic surface 194 due to charge, chemical bonding (e.g. bonding of carboxylic acid-terminated silane to the hydrophilic surface), and/or physical interactions (adhesion, surface tension) with the surface 194, to form carboxylic acid functionalized surface 192. Separately, nanoparticles 200 have been functionalized with $NH_2$ amino radicals 202 to form amine functionalized nanoparticles 198. These functionalized nanoparticles 198 are applied to the carboxylic acid functionalized surface 192 and the resulting chemical reaction creates an amide bond 206 between the carboxylic acid functionalized surface 192 and the functionalized nanoparticles 198, with water as a byproduct ($—COOH+—NH_2 \rightarrow CONH+H_2O$). In another embodiment, the treated hydrophilic surface is chemically functionalized with hydroxyl groups instead of carboxylic acid, and silane functionalized nanoparticles (rather than amine functionalized nanoparticles) are reacted with the hydroxyl groups to bind the functionalized nanoparticles to the surface and achieve the desired hydrophilic properties.

The micro and/or nanoparticles, once attached to the surface, create a highly micro-textured surface which is very hydrophilic. The micro and/or nanoparticles may be nano/microstructured materials of any size and shape, including but not limited to nanorods, nanofibers, nanoribbons, microfibers, microribbons, and/or microrods.

Thus, the process of creating the hydrophilic surface 1108 may involve just etching 1106 and/or oxidation 1104, etching and/or oxidation 1104, 1106 followed by coating/functionalization 1110 with hydrophilic material, or etching and/or oxidation 1104, 1106, followed by coating/functionalization with hydrophilic material 1110, followed by functionalization with micro and/or nanoparticles 1112.

A hydrophilic surface prepared according to any of the methods described above may be formed on an interior surface of a pipe, tube, valve, joint, pump or tank. A hydrophilic surface prepared according to any of the methods described above may also be embedded in a matrix, such as concrete, polymer, ceramic or any other matrix. For example, the hydrophilic surface may be an external surface of a reinforcement, for example metallic, ceramic or composite, embedded in concrete. For example, the hydrophilic surface may be formed on rebar which is subsequently embedded in a concrete or cement matrix, improving adhesion between the rebar and the concrete or cement.

In an aspect of the invention, the new process is used to improve the interface between steel and cement. An unmodified steel surface has poor wetting properties and results in weak adhesion with the cement. In order to improve the adhesion of steel with cement/concrete, the surface modification process is altered to provide a highly hydrophilic steel surface. The hydrophilic steel surface has better water wetting properties and hence has better adhesion to the cement. Bare steel is hydrophobic and hence, water-based cement slurry does not spread uniformly on its surface. Treating the steel and making it hydrophilic allows even spreading of water and water-based slurries on the surface. The surface treatment may be electrochemical oxidation, which results in a porous oxide nanostructure on the surface of the metal. This step makes the surface hydrophilic, lowering the water contact angle, and may be followed by etching to widen pores created in the surface by the oxidation to make the surface extremely hydrophilic. The oxidation and then etching may be repeated one or more times to achieve desired hydrophilic properties. It should be appreciated that additional steps may be taken to achieve the desired improved adhesion between steel and cement/concrete. Surface treatment may, for example, include coating with one or more layers of hydrophilic particles, including, but not limited to, nanoparticles or microparticles.

Preparing Hydrophobic Surfaces

Figure 12:
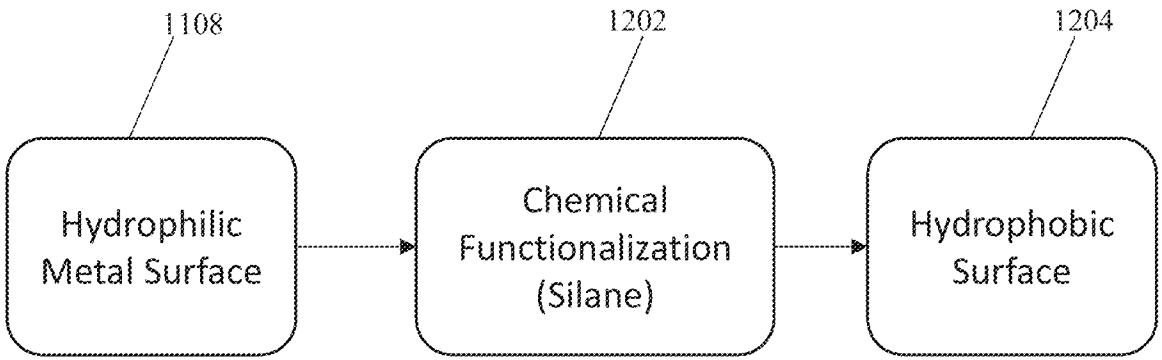
FIG. 12 is a flowchart illustrating a method of preparing a hydrophobic surface, according to some embodiments of the present invention.

FIG. 1, discussed above, illustrates a method of preparing hydrophobic surfaces according to an embodiment of the invention. FIG. 12 is a flowchart illustrating a method of preparing a hydrophobic surface in a more general manner, according to some embodiments of the present invention. To create a hydrophobic surface, first a hydrophilic surface 1108 is created by etching and oxidation 1104, 1106 as described above and with respect to FIG. 11. For purposes of ultimately creating a hydrophobic surface, the oxidation may form an oxidized layer of between 50 nm and 1000 microns in thickness on the underlying material (e.g. metal, metal alloy, ceramic, or composite). A hydrophilic coating is not applied. Instead, one or more layers of hydrophobic material are applied 1202 to the surface to chemically functionalize it and create the desired hydrophobic surface 1204.

The one or more layers of hydrophobic material may be a monomolecular layer or layers of multiple molecular thickness. The hydrophobic material may be applied by, for example, spray coating, dip coating, screen printing, electrodeposition and/or vacuum deposition. The hydrophobic material may adhere to the surface by covalent bonding, electrostatic attachment, or physisorption.

The hydrophobic material may include fluorosilane, chlorosilanes, silsesquioxanes, fluorophosphonic acids, epoxy, vinyls, mercapto groups, isocyanides, fluoroalkyls, fluoro silsesquioxanes, tetra fluoro ethylene and/or nonpolar monomers/prepolymers.

The hydrophobic material may include perfluoro silanes, poly oligomeric silsesquioxanes, perfluoro phosphonic acids, perfluoro hydrocarbons, halogenated hydrocarbons, hydrocarbons, and/or substituted hydrocarbons. For example, the hydrophobic material may be a monomolecular layer of hydrophobic molecules, for example 0.5 wt % fluorinated silane (Trichloro(1H, 1H,2H,2H-perfluorooctyl) silane in hexane.

Thus, the creation of hydrophobic surfaces according to some embodiments of the present invention is essentially the same as the process for creating the hydrophilic surfaces, in some embodiments, except that hydrophobic coating material is applied instead of hydrophilic coating material, and the hydrophobic surface is not created only by etching and oxidation.

The hydrophobic surface may be formed on an interior surface of a pipe, tube, valve, joint, pump or tank, and may reduce drag and improve the flow of water through the interior of the pipe, tube, valve, joint, pump or tank. The hydrophobic surface may also be embedded in a matrix, such as concrete, polymer, ceramic or any other matrix.

The invention is not limited to the particular embodiments illustrated in the drawings and described above in detail. Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application.

While the invention has been described with reference to specific illustrative embodiments, modifications and variations of the invention may be constructed without departing from the spirit and scope of the invention as set forth in the following claims.

What is claimed is:

1. A surface modification method, comprising:

anodizing a surface of a material and etching the anodized surface until desired nanostructures are created in the surface;

wherein the desired nanostructures make the nanostructured surface superhydrophilic, exhibiting a water contact angle of less than 30°;

wherein hydrophilic material is applied to superhydrophilic surface via screen printing;

wherein microparticles and/or nanoparticles are applied to the hydrophilic material on the superhydrophilic surface;

wherein the microparticles comprise microrods, microfibers, and/or microribbons, and/or wherein the nanoparticles comprise nanorods, nanofibers, and/or nanoribbons;

wherein the nanoparticles are functionalized with either (i) NH2 amino radicals to form amine functionalized nanoparticles, or (ii) silanes to form silane functionalized nanoparticles;

wherein the material comprises steel;

wherein the surface is embedded in a concrete or cement matrix and improves adhesion between the material and the concrete or cement; and wherein the method further comprises coating the applied microparticles and/or nanoparticles with an omniphobic material, wherein the omniphobic material coating makes the surface omniphobic, exhibiting a water contact angle of more than 100° and an oil contact angle of more than 100°.

2. The surface modification method of claim 1, wherein the desired nanostructures are each 5 nm to 10,000 nm in their longest dimension.

3. The surface modification method of claim 1, wherein the desired nanostructures comprise nanopores, each nanopore having a diameter of between 5 nm and 1,000 nm.

4. The surface modification method of claim 3, wherein each nanopore has a depth of 50 nm to 1,000 microns.

5. The surface modification method of claim 3, wherein each nanopore has a depth of 5 microns or greater.

6. The surface modification method of claim 3, wherein the desired nanostructures have a pore density of 30-50%, wherein the pore density is defined as the percentage of the surface containing the desired nanostructures.

7. The surface modification method of claim 1, wherein one or more of potassium hydroxide, sodium hydroxide, sulfuric acid, hydrochloric acid, or chromic acid is used to perform the anodization.

8. The surface modification method of claim 1, wherein one or more of sodium hydroxide, potassium hydroxide, hydrochloric acid, or oxalic acid is used to perform the etching.

9. The surface modification method of claim 1, wherein the anodizing and etching are performed at a temperature of −10° C. to 75° ° C.

10. The surface modification of claim 1, wherein the anodizing creates an anodized layer of between 50 nm and 1,000 microns in thickness on the surface of the material.

11. The surface modification method of claim 1, wherein the anodizing is performed in potassium hydroxide or sodium hydroxide.

12. The surface modification method of claim 1, wherein the hydrophilic material comprises polar monomers and/or polar prepolymers, the polar monomers and/or polar prepolymers containing amino acids, carboxylic acids, amines, sulfonates, sulfates, phosphates, acetates, borates, alcohols, thiols, nitriles, amides, aldehydes, and/or esters.

13. The surface modification method of claim 1, wherein the hydrophilic material adheres to the superhydrophilic surface by covalent bonding, electrostatic attachment, or physisorption.

14. The surface modification method of claim 1, wherein the hydrophilic material is applied in a monomolecular layer.

15. The surface modification method of claim 1, wherein the microparticles and/or nanoparticles comprise nanofibers.

16. The surface modification method of claim 1, wherein the microparticles and/or nanoparticles are applied by dip or spray coating.

17. The surface modification method of claim 1, wherein the hydrophilic material comprises hydroxyl groups and functional groups of the microparticles and/or nanoparticles comprise silane, wherein the silane reacts with the hydroxyl groups to form siloxane bonds.

18. The surface modification method of claim 1, wherein the surface is an interior surface of a pipe, tube, valve, joint, pump or tank.

19. The surface modification method of claim 1, wherein the hydrophilic material comprises carboxylic acid and the microparticles and/or nanoparticles are functionalized with amines, wherein amide bonds are formed between the microparticles and/or nanoparticles and the carboxylic acid, wherein the microparticles and/or nanoparticles create a microtextured surface onto which the omniphobic material coating is applied.

20. The surface modification method of claim 1, wherein the omniphobic material comprises low surface energy non-polar molecules.

21. The surface modification method of claim 20, wherein the low surface energy non-polar molecules comprise perfluoro octyl trichloro silane, perfluoro octyl phosphonic acid, perfluorosiloxane, fluorohydrocarbon, fluorosilane, perfluorinated acid, amine, phosphoric acid, alcohol, ethers, sulfonate, or perfluoro polyhedral oligomeric silsesquioxanes (POSS).

22. The surface modification method of claim 20, wherein the low surface energy non-polar molecules comprise non-polar monomers and/or non-polar prepolymers.

23. The surface modification method of claim 22, wherein the non-polar monomers and/or non-polar prepolymers comprise perfluoro silanes, poly oligomeric silsesquioxanes, perfluoro phosphonic acids, perfluoro hydrocarbons, halogenated hydrocarbons, hydrocarbons, and/or substituted hydrocarbons.

24. The surface modification method of claim 22, wherein a physical bond is formed between the non-polar monomers and/or non-polar prepolymers and the applied microparticles and/or nanoparticles due to adhesion and surface tension.

25. The surface modification method of claim 1, wherein coating with the omniphobic material and applying the microparticles and/or nanoparticles each comprises immersing the surface in solution.

26. The surface modification method of claim 20, wherein the low surface energy non-polar molecules form a monomolecular layer of the omniphobic surface.

27. The surface modification method of claim 1, wherein the anodizing and etching are repeated one or more times to obtain the desired nanostructures.

28. A surface modification method, comprising:

anodizing a metal surface and etching the anodized surface until a plurality of nanopores are created in the metal surface;

wherein the anodizing is performed with potassium hydroxide, sodium hydroxide, sulfuric acid, hydrochloric acid, or chromic acid;

wherein the etching comprises soaking in sodium hydroxide or potassium hydroxide for three minutes or less;

wherein the plurality of nanopores make the nanopored surface superhydrophilic such that the nanopored surface exhibits a water contact angle of less than 30°;

wherein the plurality of nanopores has a pore density of 30% to 50%, wherein the pore density is defined as the percentage of the metal surface containing the plurality of nanopores;

wherein each of the plurality of nanopores has a diameter of between 5 nm and 1,000 nm, and wherein each of the plurality of nanopores has a depth of between 1 micron and 20 microns;

wherein hydrophilic material is applied to superhydrophilic surface via screen printing;

wherein microparticles and/or nanoparticles are applied to the hydrophilic material on the superhydrophilic surface;

wherein the microparticles comprise microrods, microfibers, and/or microribbons, and/or wherein the nanoparticles comprise nanorods, nanofibers, and/or nanoribbons;

wherein the nanoparticles are functionalized with either (i) NH2 amino radicals to form amine functionalized nanoparticles, or (ii) silanes to form silane functionalized nanoparticles;

wherein the anodized metal surface comprises anodized steel;

wherein the anodized steel exhibits enhanced adhesion to cement;

wherein cement slurry spreads with enhanced uniformity across the anodized steel surface relative to bare hydrophobic steel;

wherein the anodized steel comprises rebar;

wherein the superhydrophilic surface is embedded in a matrix, wherein the matrix comprises concrete or cement, and wherein the superhydrophilic surface has improved wetting properties relative to an unmodified steel surface such that the superhydrophilic surface has improved adhesion with the concrete or cement relative to the unmodified steel surface.

29. The surface modification method of claim 28, wherein the etching comprises soaking in hydrochloric acid or oxalic acid.

30. A surface modification method, comprising:

anodizing a steel surface with potassium hydroxide, sodium hydroxide, sulfuric acid, and/or hydrochloric acid, to generate an oxidized steel surface;

etching the oxidized steel surface by soaking in potassium hydroxide or sodium hydroxide for three minutes or less at a temperature of between −10 degrees Celsius and 75 degrees Celsius until a plurality of nanopores are created in the oxidized steel surface, to generate a nanopored superhydrophilic surface that exhibits a water contact angle of less than 30°; and applying one or more layers of a hydrophilic material to the nanopored superhydrophilic surface, to generate a modified steel surface, applying microparticles and/or nanoparticles to the one or more layers of the hydrophilic material on the nanopored superhydrophilic surface, wherein the microparticles comprise microrods, microfibers, and/or microribbons, and/or wherein the nanoparticles comprise nanorods, nanofibers, and/or nanoribbons, wherein the modified steel surface exhibits enhanced adhesion to cement, wherein cement slurry spreads with enhanced uniformity across the modified steel surface relative to a bare steel surface, wherein the modified steel surface is formed on rebar, wherein the rebar is embedded in a concrete or cement matrix, and wherein the modified steel surface has improved wetting properties relative to the bare steel surface such that the modified steel surface has improved adhesion with the concrete or cement matrix relative to the bare steel surface.

31. The method of claim 30, wherein the nanoparticles are functionalized with either (i) $NH_2$ amino radicals to form amine functionalized nanoparticles, or (ii) silanes to form silane functionalized nanoparticles, wherein the plurality of nanopores has a pore density of 30% to 50%, wherein the pore density is defined as the percentage of the metal surface containing the plurality of nanopores, wherein each of the plurality of nanopores has a diameter of between 5 nm and 1,000 nm, and wherein each of the plurality of nanopores has a depth of between 1 micron and 20 microns.

* * * * *